US007628663B2

(12) United States Patent
McKinney

(10) Patent No.: US 7,628,663 B2
(45) **Date of Patent: *Dec. 8, 2009**

(54) MARINE ENGINE EXHAUST SYSTEM WITH COOLING ARRANGEMENT

(75) Inventor: Mark C. McKinney, Irmo, SC (US)

(73) Assignee: Pleasurecraft Marine Engine Co., Little Mountain, SC (US)

( * ) Notice: Subject to any disclaimer, the term of this patent is extended or adjusted under 35 U.S.C. 154(b) by 58 days.

This patent is subject to a terminal disclaimer.

(21) Appl. No.: 11/893,023

(22) Filed: Aug. 14, 2007

(65) Prior Publication Data

US 2009/0047849 A1 Feb. 19, 2009

(51) Int. Cl.
*B63H 21/32* (2006.01)

(52) U.S. Cl. ..... 440/89 C; 440/89 B; 440/89 R

(58) Field of Classification Search ..... 440/88 HE, 440/88 J, 89 C, 89 R, 89 B; 60/310, 311
See application file for complete search history.

(56) References Cited

U.S. PATENT DOCUMENTS

| | | | | |
|---|---|---|---|---|
| 1,824,736 | A | 9/1931 | Johnson et al. | |
| 3,206,836 | A | 9/1965 | Schlussler | |
| 4,504,238 | A | 3/1985 | Neisen | |
| 4,573,318 | A | 3/1986 | Entringer et al. | |
| 4,687,450 | A | 8/1987 | Bland et al. | |
| 4,734,071 | A | 3/1988 | Zemlicka et al. | |
| 4,759,181 | A | 7/1988 | Biritz | |
| 4,801,283 | A | 1/1989 | Ruhnke | |
| 4,831,822 | A * | 5/1989 | Yoshimura | 440/89 R |
| 4,845,945 | A | 7/1989 | Widmer et al. | |
| 4,977,741 | A | 12/1990 | Lulloff et al. | |
| 4,997,399 | A | 3/1991 | Nakayasu et al. | |
| 5,109,668 | A | 5/1992 | Lindstedt | |
| 5,531,620 | A | 7/1996 | Ozawa et al. | |
| 5,820,426 | A | 10/1998 | Hale | |
| 6,022,254 | A | 2/2000 | Neisen | |
| 6,030,263 | A | 2/2000 | Uchino et al. | |
| 6,120,335 | A | 9/2000 | Nakase et al. | |
| 6,183,324 | B1 | 2/2001 | Nanami | |
| 6,290,558 | B1 | 9/2001 | Erickson | |

(Continued)

OTHER PUBLICATIONS

United States Office Action issued in U.S. Appl. No. 11/729,671; titled "United States Office Action"; Author Swinehart, Edwin L.; mailed on Mar. 2, 2009; (7 pages).

(Continued)

*Primary Examiner*—Lars A Olson
(74) *Attorney, Agent, or Firm*—J. Bennett Mullinax, LLC

(57) ABSTRACT

A marine engine exhaust system is provided. The system includes a first and second manifold. A first conduit is in fluid communication with the first manifold so that a first gas is transferred into a first gas passageway of the first conduit. The first conduit has a first cooling fluid passageway. A second conduit is in fluid communication with the second manifold so that a second gas exiting the second manifold is transferred into a second gas passageway of the second conduit. The second conduit has a second cooling fluid passageway. Cooling fluid is transferred through the first cooling fluid passageway so as to have a direction of flow through the first conduit opposite to the direction of flow of the first gas through the first gas passageway of the first conduit.

20 Claims, 8 Drawing Sheets

U.S. PATENT DOCUMENTS

| | | | | |
|---|---|---|---|---|
| 6,412,595 | B1 | 7/2002 | Horak et al. | |
| 6,454,622 | B2 | 9/2002 | Mashiko et al. | |
| 6,511,355 | B1 | 1/2003 | Woodward | |
| 6,582,263 | B1 | 6/2003 | Jaeger et al. | |
| 6,638,124 | B2 | 10/2003 | Zoubul et al. | |
| 6,644,024 | B1 | 11/2003 | Powers et al. | |
| 6,672,919 | B1 | 1/2004 | Beson | |
| 6,764,361 | B1 | 7/2004 | Matsuda | |
| 6,800,004 | B1 | 10/2004 | White et al. | |
| 6,802,750 | B2 | 10/2004 | Hellmann | |
| 6,929,520 | B1 | 8/2005 | Hughes et al. | |
| 7,314,044 | B2 * | 1/2008 | Westerbeke | 123/672 |
| 2004/0035100 | A1 | 2/2004 | Westerbeke et al. | |
| 2004/0063364 | A1 | 4/2004 | Matsuda | |
| 2005/0120705 | A1 | 6/2005 | Westerbeke, Jr. | |

OTHER PUBLICATIONS

Indmar, Web site print outs from www.indmar.com for Indmar Introduces First Production Catalyst For Inboard Engines, visited Oct. 2, 2006, (3 pages).

Malibu Boats, Web site print outs from www.malibuboats.com for BalibuBoats 2007, visited Oct. 17, 2006, (2 pages).

U.S. Appl. No. 11/729,671; titled "Marine Engine Exhaust System"; Inventor: Mark C. McKinney; filed on Mar. 29, 2007; (38 pages).

United States Office Action issued in Patent U.S. Appl. No. 11/729,671; titled "United States Office Action"; Author Swinehart, Edwin L.; mailed on Jul. 13, 2009; copy encolsed (8 pages).

* cited by examiner

MARINE ENGINE EXHAUST SYSTEM WITH COOLING ARRANGEMENT

FIELD OF THE INVENTION

The present invention relates generally to an exhaust system for an inboard marine engine. More particularly, the present application involves a marine engine exhaust system for use with a twin head engine that has a cooling arrangement.

BACKGROUND

Marine engines used to power watercraft can be generally classified as either being an inboard, outboard, or stern drive. An inboard engine is located inside of the watercraft and poses certain design challenges. For example, an inboard engine is generally confined to a small space in which air flow is limited. Limitations of air flow around the engine require a sufficient cooling arrangement be in place in order to handle heat generated during use. Further, as the engine is operated in a marine environment precautions must be taken in order to prevent water from finding its way inside of and consequently damaging the engine.

One type of inboard marine engine employed on watercraft is a twin head engine. This type of engine features cylinders that are located on opposite sides of the engine that generate exhaust gases upon firing. Manifolds are commonly employed in order to channel the exhaust gases into a single stream on one side of the engine and into a single stream on the opposite side of the engine. The two exhaust gas streams may then be routed to a discharge point from which the exhaust gases can exit the watercraft. Alternative arrangements are known in which the two separate exhaust gas streams are combined into one stream and subsequently routed to a discharge point. The two manifolds are designed in order to inhibit the movement of water through the manifolds and into the inboard engine.

The gas streams can be transferred from the manifolds in jacketed conduits. A cooling fluid, such as water or antifreeze, is transferred through the jacketed conduits and kept separate from the gas streams in order to draw heat from the gas streams and cool the exhaust system. The cooling fluid is inserted into the conduits proximate to the manifolds and flows in the same direction through the conduits as does the exhaust gases. It may be the case that cooling fluid is not present at certain locations of the conduits. For example, the top of the conduits may not have cooling fluid present due to the fact that the cooling fluid is drawn by gravity down to the bottom of the conduits as the cooling fluid flows therethrough. Further, the orientation of the conduits themselves may be provided so that certain portions are void of cooling fluid. The absence of cooling fluid at certain locations leads to the formation of hot spots on the conduits at these locations. Hot spots may result in the burning of individuals should they come into contact therewith. Further, hot spots may cause a fire aboard the watercraft, and hot spots could lead to a weakening of components of the exhaust system which may cause it to fail. As such, there remains room for variation and improvement within the art.

SUMMARY

Various features and advantages of the invention will be set forth in part in the following description, or may be obvious from the description, or may be learned from practice of the invention.

One aspect of one exemplary embodiment provides for a marine engine exhaust system that includes first and second manifolds. A first corner is in fluid communication with the first manifold so that a first gas exiting the first manifold is transferred into the first corner. The first corner has a first corner cooling fluid passageway. A second corner is in fluid communication with the second manifold so that a second gas exiting the second manifold is transferred into the second corner. The second corner has a second corner cooling fluid passageway. A crossover is in fluid communication with the first corner and the second corner so that the first gas exiting the first corner is transferred into the crossover and so that the second gas exiting the second corner is transferred into the crossover. The crossover has a crossover cooling fluid passageway configured for receiving cooling fluid. The crossover cooling fluid passageway is configured for allowing cooling fluid to be transferred into the first corner cooling fluid passageway and the second corner cooling fluid passageway.

Another aspect of an additional exemplary embodiment includes a marine engine exhaust system as immediately discussed in which the cooling fluid is water.

A further aspect of another exemplary embodiment exists in a marine engine exhaust system as described above in which the first manifold has a first catalyst for treating the first gas. Also, the second manifold has a second catalyst for treating the second gas.

An additional aspect includes an exemplary embodiment of a marine engine exhaust system as mentioned above in which the crossover cooling fluid passageway is oriented with respect to the first corner cooling fluid passageway and the second corner cooling fluid passageway. The crossover cooling fluid passageway is oriented so that cooling fluid fills the crossover cooling fluid passageway before filling at least substantially all of the first corner cooling fluid passageway and the second corner cooling fluid passageway.

Also provided in accordance with another aspect of one exemplary embodiment is a marine engine exhaust system as previously mentioned that has a heat exchanger. The cooling fluid is antifreeze. The first corner cooling fluid passageway and second corner cooling fluid passageway are configured to allow the antifreeze to be transferred therefrom and into the heat exchanger in order to be cooled. The heat exchanger is configured to allow the antifreeze to be transferred therefrom and to an engine in order to cool the engine.

An additional aspect of one exemplary embodiment includes a marine engine exhaust system as previously discussed in which the first gas and second gas are maintained separate from one another in the crossover. Also included is an elbow in fluid communication with the crossover so that the first gas exiting the crossover is transferred into the elbow. The second gas exiting the crossover is likewise transferred into the elbow. The elbow is configured to allow the first gas and the second gas to merge with one another.

A further aspect of another exemplary embodiment resides in a marine engine exhaust system that has a first manifold and a second manifold. A first conduit is in fluid communication with the first manifold so that a first gas exiting the first manifold is transferred into a first gas passageway of the first conduit. The first conduit has a first cooling fluid passageway. A second conduit is in fluid communication with the second manifold so that a second gas exiting the second manifold is transferred into a second gas passageway of the second conduit. The second conduit has a second cooling fluid passageway. Cooling fluid is transferred through the first cooling fluid passageway so as to have a direction of flow through the first conduit opposite to the direction of flow of the first gas through the first gas passageway of the first conduit.

An additional exemplary embodiment includes a marine engine exhaust system as immediately discussed in which cooling fluid is transferred through the second cooling fluid passageway. The cooling fluid has a direction of flow through the second conduit opposite to the direction of flow of the second gas through the second gas passageway of the second conduit.

Another aspect of a further exemplary embodiment is present in a marine engine exhaust system as mentioned above that further has a third conduit in fluid communication with the first conduit and second conduit. The first gas exiting the first conduit and the second gas exiting the second conduit merge in the third conduit. Cooling water is merged with the first gas in the first conduit and with the second gas in the second conduit before the first gas and the second gas merge in the third conduit.

Also provided in accordance with another aspect is a marine engine exhaust system as previously mentioned that further includes a heat exchanger. The cooling fluid is antifreeze. The first cooling fluid passageway and second cooling fluid passageway are configured to allow the antifreeze to be transferred therefrom and into the heat exchanger to be cooled. The heat exchanger is configured to allow the antifreeze to be transferred therefrom and to an engine in order to cool the engine.

An additional aspect exists in an exemplary embodiment of a marine engine exhaust system that has a first corner configured for the transfer of a first gas therethrough. The first corner has a first corner cooling fluid passageway. A second corner is configured for the transfer of a second gas therethrough. The second corner has a second corner cooling fluid passageway. A crossover is in fluid communication with the first corner and second corner so that the first gas exiting the first corner is transferred into the crossover and so that the second gas exiting the second corner is transferred into the crossover. Cooling fluid is located in the first corner cooling fluid passageway and flows therethrough. The direction of flow of the first gas through the first corner is different than the direction of flow of the cooling fluid through the first corner.

Another aspect of a further exemplary embodiment is found in a marine engine exhaust system as immediately mentioned in which cooling fluid is located in the second corner cooling fluid passageway and flows therethrough. The direction of flow of the first gas through the first corner is different than the direction of flow of the cooling fluid through the first corner. The direction of flow of the cooling fluid through the first corner is opposite to the direction of flow of the first gas through the first corner. The direction of flow of the cooling fluid through the second corner is opposite to the direction of flow of the second gas through the second corner.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
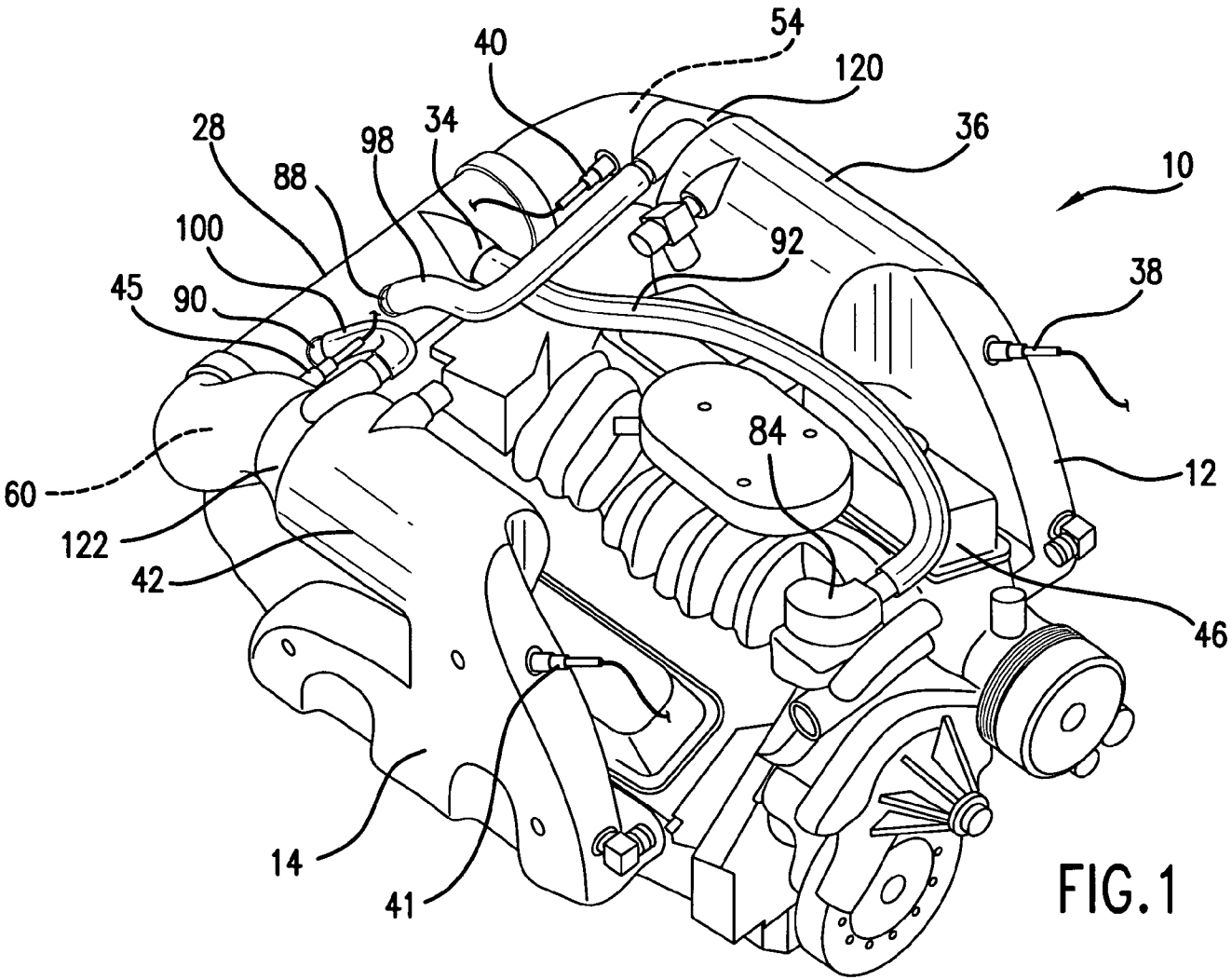
FIG. 1 is a perspective view of a marine engine exhaust system in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a marine engine exhaust system 10 that can be used on a twin head inboard engine 46 in a watercraft. The marine engine exhaust system 10 may include a pair of conduits 52 and 58 extending from a pair of manifolds 12 and 14 of the engine 46 through which exhaust gases 18 and 24 are transferred. Cooling fluid 32 can be transferred through the conduits 52 and 58 in order to provide cooling to the system 10. The cooling fluid 32 can be introduced in such a manner that the cooling fluid 32 flows in a direction opposite to the direction of flow of the gases 18 and 24 through the conduits 52 and 58. The conduits 52 and 58 can be arranged so that the cooling fluid 32 fills the low points of the conduits 52 and 58 first through gravity and then eventually fills the remaining portions of the conduits 52 and 58 before being transferred therefrom. Arrangement of the conduits 52 and 58 in this manner reduces the occurrence of hot spots thereon as cooling fluid 32 is able to find its way into a greater portion of the conduits 52 and 58.

FIG. 1 shows a marine engine exhaust system 10 in accordance with one exemplary embodiment of the present invention. The marine engine exhaust system 10 is shown being used in conjunction with an engine 46 that is an eight cylinder twin head marine engine. It is to be understood, however, that other exemplary embodiments exist in which the engine 46 may be variously configured. A first manifold 12 is located on one side of the engine 46 and is in communication with the cylinders of the engine 46 located on this side. The first manifold 12 is used to transport exhaust gas from the engine 46 and typically includes internal features, such as runners, that are used to more easily channel the gas from the individual cylinders to a single stream. The manifold 12 may also include additional internal features, such as damns, that act to catch water and prevent it from regressing back into and damaging the engine 46.

The first manifold 12 may include a first catalyst 36 in accordance with certain exemplary embodiments of the present invention. The first catalyst 36 functions to reduce pollutants in a first gas 18 passing therethrough from the engine 46. An oxygen sensor 38 may be included in the first manifold 12 and positioned to acquire data regarding the first gas 18 before entering the first catalyst 36. An additional oxygen sensor 40 is located after the first catalyst 36 and monitors the first gas 18 exiting therefrom. The functionality of the first catalyst 36 can be monitored and information retrieved can be used to modify the running of engine 46 or other components of the watercraft. The first catalyst 36 can be of any type used with engine exhaust systems. Typically, the first catalyst 36 works best if the first gas 18 is both hot and dry. In fact, water may damage the first catalyst 36, oxygen sensor 38 and oxygen sensor 40 in certain embodiments thus making water control at this portion of the marine engine exhaust system 10 desirable.

A second manifold 14 is located on the side of engine 46 opposite that of the first manifold 12. The second manifold 14 receives exhaust gases from the cylinders located on the side of engine 46 opposite the first manifold 12. The second manifold 14 may be provided in a manner similar to the first manifold 12 as previously discussed and a repeat of the features and functionality is not necessary. Additionally, a second catalyst 42 can be provided in order to treat a second gas 24 transferred from the second manifold 14. The second catalyst 42 along with oxygen sensors 41 and 45 can be provided as previously discussed with respect to the first catalyst 36 and oxygen sensors 38 and 40 and repeating their features and functionality is likewise not necessary. Although described as employing catalysts 36 and 42, it is to be understood that other embodiments of the present system 10 are possible in which either one of or both of the catalysts 36 and 42 and associated oxygen sensors 38, 40, 41 and 45 are not present. Further, catalyst 36 may be made of different materials or may have a construction different than catalyst 42 in accordance with certain exemplary embodiments.

The engine 46 in the exemplary embodiment of FIG. 1 makes use of a raw water cooling system. A raw water system employs water as the cooling fluid 32 and obtains this water from the body of water into which the watercraft is deployed. The water is routed to various portions of the engine 46 in order to draw heat therefrom and hence effect cooling. A thermostat 84 is shown and is used to regulate the temperature of the engine 46 and may also be used, if desired, to regulate the temperature of the manifolds 12 and 14. In use the majority of water passes through the thermostat 84 and is routed to various portions of the engine 46 while some water is directed from thermostat 84 into a by-pass line 92 and into a crossover 28 of the marine engine exhaust system 10. Upon detecting the temperature of water flowing therethrough, the thermostat 84 can regulate the quantity of water transferred into the by-pass line 92 in order to adjust the temperature of the cooling water 32 and in turn regulate the temperature of any one of or all of the engine 46, first manifold 12 and second manifold 14.

Figure 2:
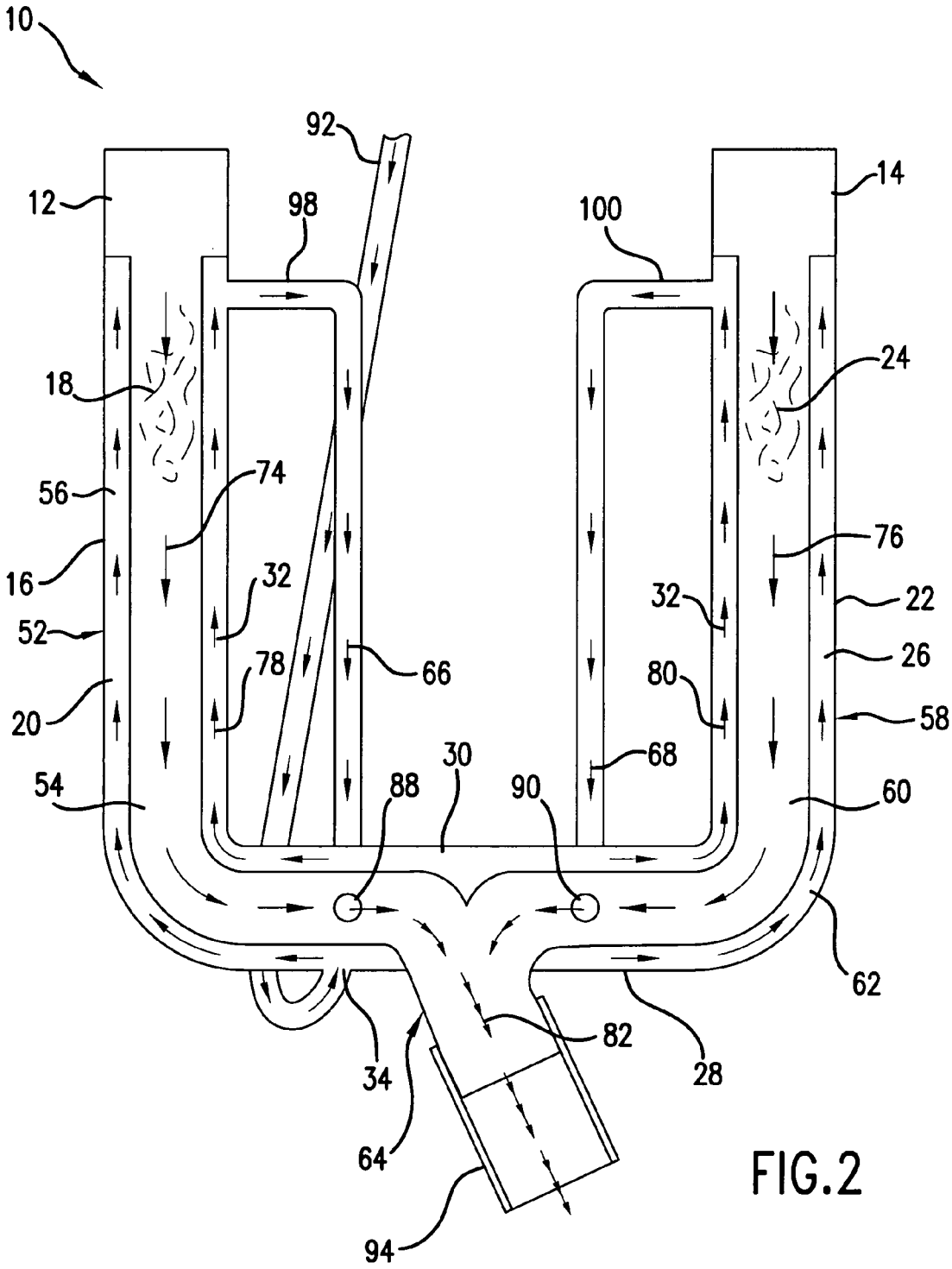
FIG. 2 is a schematic circuit view of the marine engine exhaust system of FIG. 1.

A schematic view of the marine engine exhaust system 10 of FIG. 1 is shown in FIG. 2. The first and second manifolds 12 and 14 function to transport the first gas 18 and second gas 24 therefrom without the presence of cooling water mixed with the gases 18 and 24. The first gas 18 is transferred from the first manifold 12 into a first conduit 52. In a similar fashion, the second gas 24 is transferred from the second manifold 14 into a second conduit 58. The first conduit 52 and second conduit 58 may be defined in a first corner 16 and second corner 22, respectively, in accordance with one embodiment of the present invention. The first conduit 52 and second conduit 58 are in fluid communication with a third conduit 64. The third conduit 64 may be located in a crossover 28 that is connected to an end of the first corner 16 and second corner 22. The first gas 18 can exit the first conduit 52 of the first corner 16 and enter the third conduit 64 of the crossover 28 in the downstream direction of flow. The second gas 24 in second conduit 58 of the second corner 22 can also exit therefrom into the third conduit 64 of the crossover 28 in the downstream direction of flow.

As the first gas 18 and second gas 24 are hot exiting the cylinders of the engine 46, cooling fluid 32 is present in order to cool various components of the marine engine exhaust system 10. As stated, the cooling fluid 32 is water in the exemplary embodiment shown in FIG. 2. The cooling fluid 32 is transferred by way of by-pass line 92 through port 34 and into a crossover cooling fluid passageway 30 of the crossover 28. The cooling fluid 32 then proceeds to fill up the crossover cooling fluid passageway 30 and may do so upon filling from the bottom to the top of the crossover cooling fluid passageway 30. This may be the case as the cooling fluid 32 will attempt to find the low point of the crossover cooling fluid passageway 30 first due to gravity.

Cooling fluid 32 then proceeds to flow into the first cooling fluid passageway 56 and the second cooling fluid passageway 62 from the crossover cooling fluid passageway 30. When corners 16 and 22 are used, the first cooling fluid passageway 56 is a first corner cooling fluid passageway 20 and the second cooling fluid passageway 62 is a second corner cooling fluid passageway 26. The cooling fluid 32 flows in the direction from the crossover cooling fluid passageway 30 to the first manifold 12 in the first cooling fluid passageway 56. Similarly, the cooling fluid 32 flows in the direction from the crossover cooling fluid passageway 30 to the second manifold 14 in the second cooling fluid passageway 62. Cooling fluid 32 exits the first cooling fluid passageway 56 into line 98, and cooling fluid 32 exits the second cooling fluid passageway 62 into line 100.

Cooling fluid 32 in line 98 is designated as cooling water 66 while cooling fluid 32 in line 100 is designated as cooling water 68. Cooling water 66 flows through port 88 and into the third conduit 64 to merge with the first gas 18. In a similar manner, cooling water 68 flows through a port 90 and merges with the second gas 24 in the third conduit 64. These merged streams are represented by double arrows in FIG. 2. Cooling water 66 can merge with first gas 18, and cooling water 68 can merge with second gas 24 before the first gas 18 and second gas 24 merge with one another. A combined stream 82 of the first gas 18, second gas 24, cooling water 66 and cooling water 68 can be formed and can be transferred through a hose 94 to a desired discharge point. This combined stream 82 is shown as a triple arrow. Introduction of the cooling water 66 and 68 before merging of the first gas 18 and second gas 24 functions to condense and cool the first gas 18 and second gas 24 and in turn reduces backpressure on the engine 46. Although shown as merging with the first gas 18 and second gas 24, it is to be understood that other arrangements are possible in which cooling water 66 and 68 merges with the first gas 18 and second gas 24 after the two gases merge with one another. Further, additional embodiments are also possible in which cooling water 66 and 68 does not merge with the first gas 18 and second gas 24. It is to be understood that the merging scheme shown is but one possible embodiment and that other are possible.

Cooling water 66 and 68 that flows through ports 88 and 90 can be of any amount. For example, all of the cooling water discharged in the marine engine exhaust system 10 in the described circuit can flow through ports 88 and 90. Alternatively, the cooling water 66 and 68 may be transferred through ports 88 and 90 in a mist form. Here, the additional cooling water 66 and 68 can be transferred to a downstream location for disposal from the system 10. This downstream location may feature mixing with the combined stream 82 or may be discharged separate from the gases 18 and 24 and any previous misted cooling water 66 or 68.

Referring now to both FIGS. 1 and 2, the marine engine exhaust system 10 is arranged so that the crossover 28 is located at a position that is generally vertically below the first corner 16 and second corner 22. In this regard, cooling water 66 and 68 that enters the crossover 28 will first fill from the bottom of the crossover cooling fluid passageway 30 to the top due to gravity acting on the cooling water 66 and 68 upon entering the crossover cooling fluid passageway 30. Upon filling the crossover cooling fluid passageway 30, the cooling water 66 and 68 will then proceed to fill the vertically lowest portions of the first and second corner cooling fluid passageways 20 and 26. The cooling water 66 and 68 fills the first and second corner cooling fluid passageways 20 and 26 from their vertically lowest portions to their vertically highest portions. The cooling water 66 and 68 can exit the first and second corner cooling fluid passageways 20 and 26 into lines 98 and 100 through ports that can be located at the vertically highest points of the first and second corner cooling fluid passageways 20 and 26. It is to be understood, however, that in other embodiments the lines 98 and 100 can be provided cooling water 66 and 68 through ports that are not at the vertically highest portions of the first and second corner cooling fluid passageways 20 and 26. Cooling water 66 and 68 fills the conduits 52, 58 and 64 from their vertically lowest positions to their vertically highest positions. This method of filling the conduits 52, 58 and 64 acts to push air pockets therefrom so that the passageways 20, 26 and 30 are essentially completely filled with cooling water 66 and 68. As such, air pockets are not present in the passageways 20, 26 and 30 and associated hot spots are not present on the first corner 16, second corner 22 and crossover 28.

Figure 3:
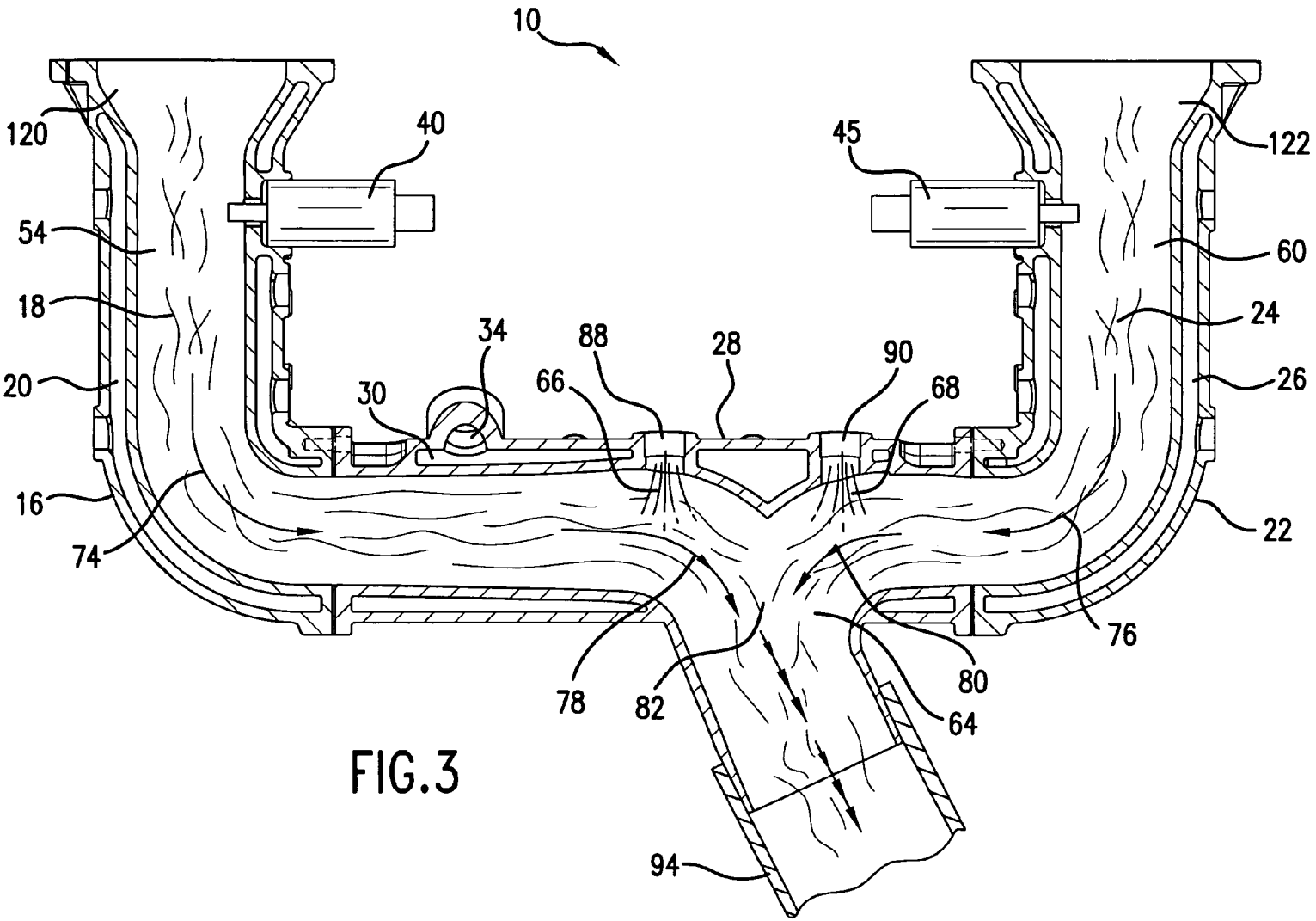
FIG. 3 is a cross-sectional view showing the corners and crossover of the marine engine exhaust system of FIG. 1.

FIG. 3 is a cross-sectional view of the corners 16 and 22 and the crossover 28. The first corner cooling fluid passageway 20 is shown as jacketing a first gas passageway 54 through which the first gas 18 travels. In a similar manner, the second corner cooling fluid passageway 26 jackets a second gas passageway 60 through which the second gas 24 flows. The crossover cooling fluid passageway 30 jackets portions of both the first and second gas passageways 54 and 60. the fluid passageways 20, 26 and 30 can be arranged in various ways in accordance with other exemplary embodiments. For example, the fluid passageways 20, 26 and 30 can be provided so as to surround only one side of the first and second gas passageways 54 and 60 in other arrangements.

The crossover 28 is a separate component that is attached to an end of the first corner 16 and second corner 22. Other arrangements are possible in which these components can be a single unitary piece or may be separate elements that are attached to one another. Also shown in FIG. 3 is an arrangement in which the first and second corner cooling fluid passageways 20 and 26 are placed into fluid communication with the crossover cooling fluid passageway 30. Other arrangements are also possible. For example, hoses may be used in order to "jump" the cooling water 66 and 68 from the crossover cooling fluid passageway 30 to the first and second corner cooling fluid passageways 20 and 26 to avoid the points of connection between the crossover 28 and the first and second corners 16 and 22. The port 34 in FIG. 3 is shown as being located generally at the top of the crossover 28 such that cooling fluid 32 from the by-pass line 92 enters the top of the crossover cooling fluid passageway 30. With such an arrangement, cooling fluid 32 will still fall to the bottom of the crossover cooling fluid passageway 30 due to gravity in order to fill this passageway from the bottom to the top. In other arrangements, port 34 can be located generally at the bottom of the crossover cooling fluid passageway 30 if desired.

Figure 4:
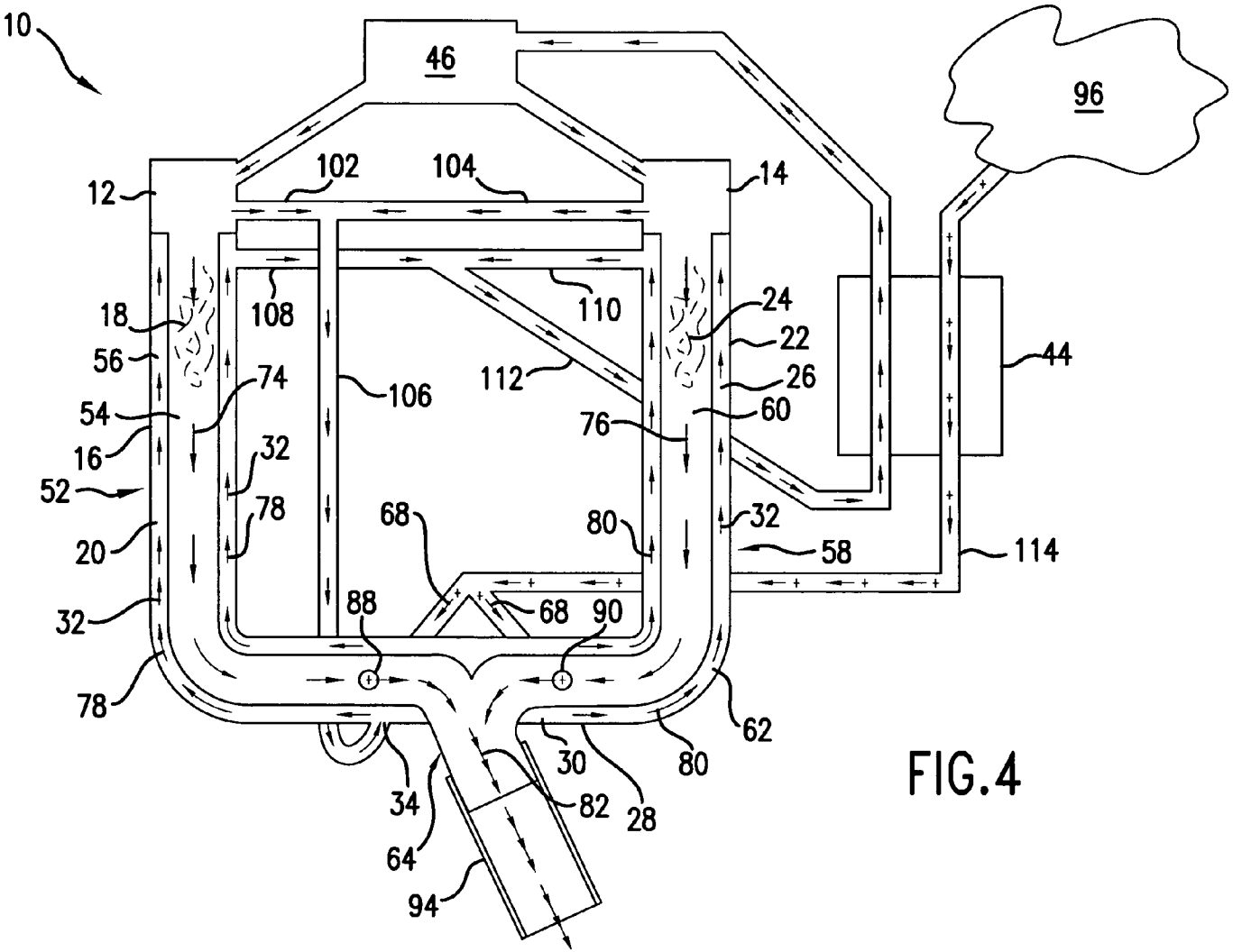
FIG. 4 is a schematic circuit view of a marine engine exhaust system in accordance with another exemplary embodiment.

A schematic circuit view of an additional exemplary embodiment of the marine engine exhaust system 10 is shown in FIG. 4. The engine 46 onto which the marine engine exhaust system 10 is employed is a twin head eight cylinder engine. The first and second manifolds 12 and 14 along with the first and second corners 16 and 22 may be constructed as previously described with respect to the exemplary embodiment of FIG. 1 and a repeat of their possible design configurations is not necessary. Catalysts 36 and 42 along with associated oxygen sensors 38, 40, 41 and 45 may also be included as previously discussed above and need not be repeated here. The exemplary embodiment shown in FIG. 4 employs a cooling fluid 32 that is antifreeze. As such, the marine engine exhaust system 10 in FIG. 4 is commonly known as a fresh water system. Cooling fluid 32 flows through and cools the manifolds 12 and 14. The cooling fluid 32, which again is antifreeze in this system, exits manifold 12 into line 102 and exits manifold 14 into line 104. Lines 102 and 104 merge to form line 106 through which the cooling fluid 32 is transferred.

Cooling fluid 32 enters the crossover cooling fluid passageway 30 through port 34 and proceeds to fill the crossover cooling fluid passageway 30 from the bottom up due to gravity. The cooling fluid 32 then flows into the first and second cooling fluid passageways 56 and 62 in a manner similar to that previously discussed with respect to the exemplary embodiment in FIG. 1. The arrangement of the marine engine exhaust system 10 in FIG. 4 is made so as to reduce hot spots on the corners 16 and 22 and crossover 28 and a repeat of this information is not necessary. Cooling fluid 32 enters line 108 upon exiting the first cooling fluid passageway 56. Cooling fluid 32 likewise exits the second cooling fluid passageway 62 and enters line 110. Lines 108 and 110 merge to form line 112 through which the combined cooling fluid 32 flows.

A heat exchanger 44 is present in the exemplary embodiment of FIG. 4. The cooling fluid 32 flowing through line 112 is hot as it has traveled through the engine 46, manifolds 12 and 24, first corner 16, second corner 22 and crossover 28 which are generally hot. The heat exchanger 44 receives water from the body of water 96 into which the watercraft rests such as a lake, river or ocean. The water received by the heat exchanger 44 is thus generally cool. Heat from the cooling fluid 32 in line 112 is transferred into the water in line 114 in the heat exchanger 44. The warmed water in line 114 then exits the heat exchanger 44 and is split into cooling water 66 and cooling water 68 which flows through ports 88 and 90 respectively. Cooling water 66 is merged with the first gas 18 and cooling water 68 is merged with the second gas 24 in a manner previously described with respect to the exemplary embodiment in FIG. 1. As such, a repeat of this arrangement is not needed.

Cooling fluid 32 is thus cooled upon traveling through and exiting the heat exchanger 44. The cooled cooling fluid 32 is then transferred to the engine 46 in order to cool various components thereof. Subsequently, the cooling fluid 32 is transferred into the first manifold 12 and second manifold 14 and acts to cool these components before being transferred into lines 102 and 104. The aforementioned cycle thus repeats itself. As with the exemplary embodiment in FIG. 1, the combined stream 82 of first gas 18, second gas 24, cooling water 66 and cooling water 68 can be transferred by way of hose 94 to a desired location to be removed from the watercraft.

Figure 5:
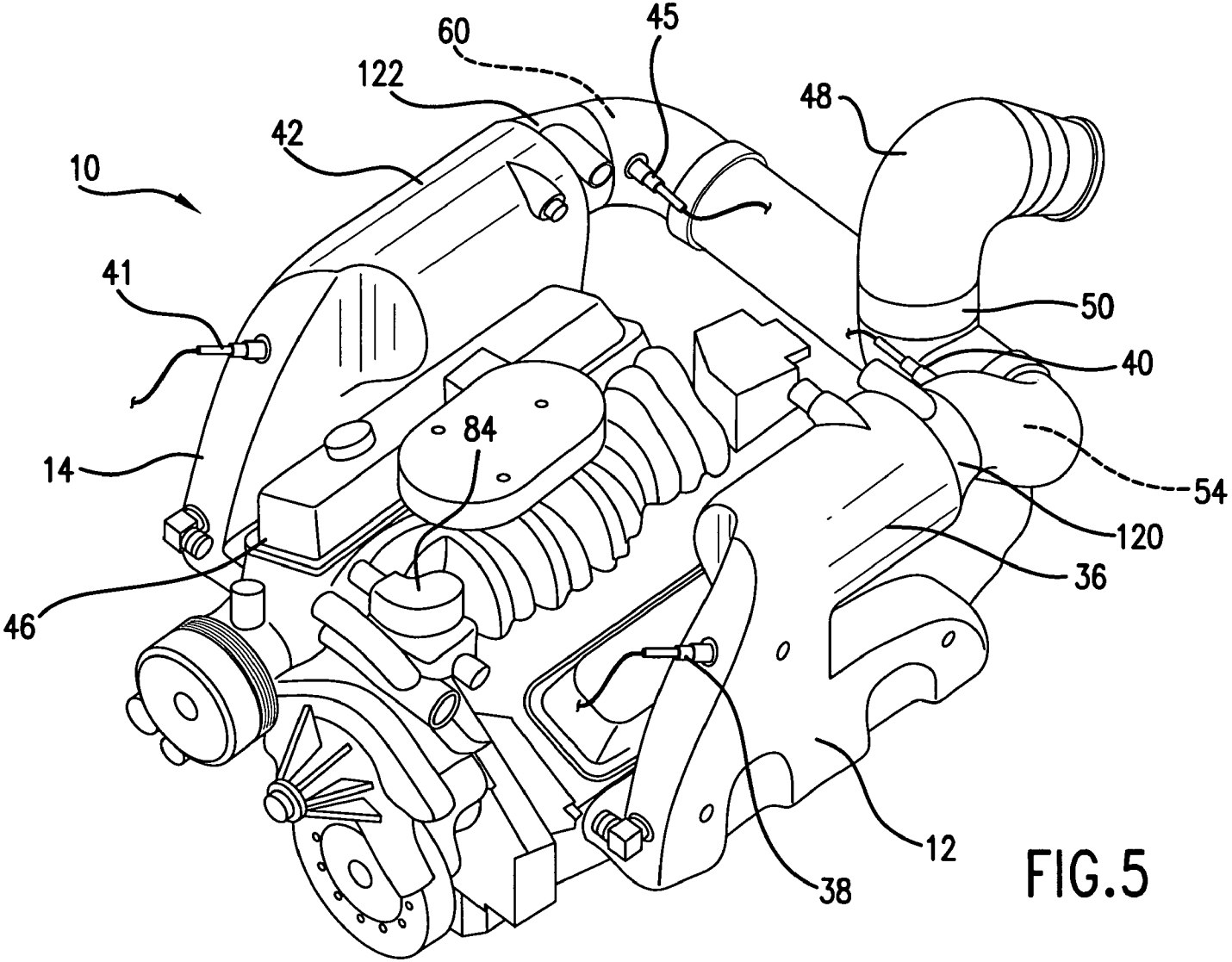
FIG. 5 is a perspective view of a marine engine exhaust system in accordance with yet another exemplary embodiment.
Figure 6:
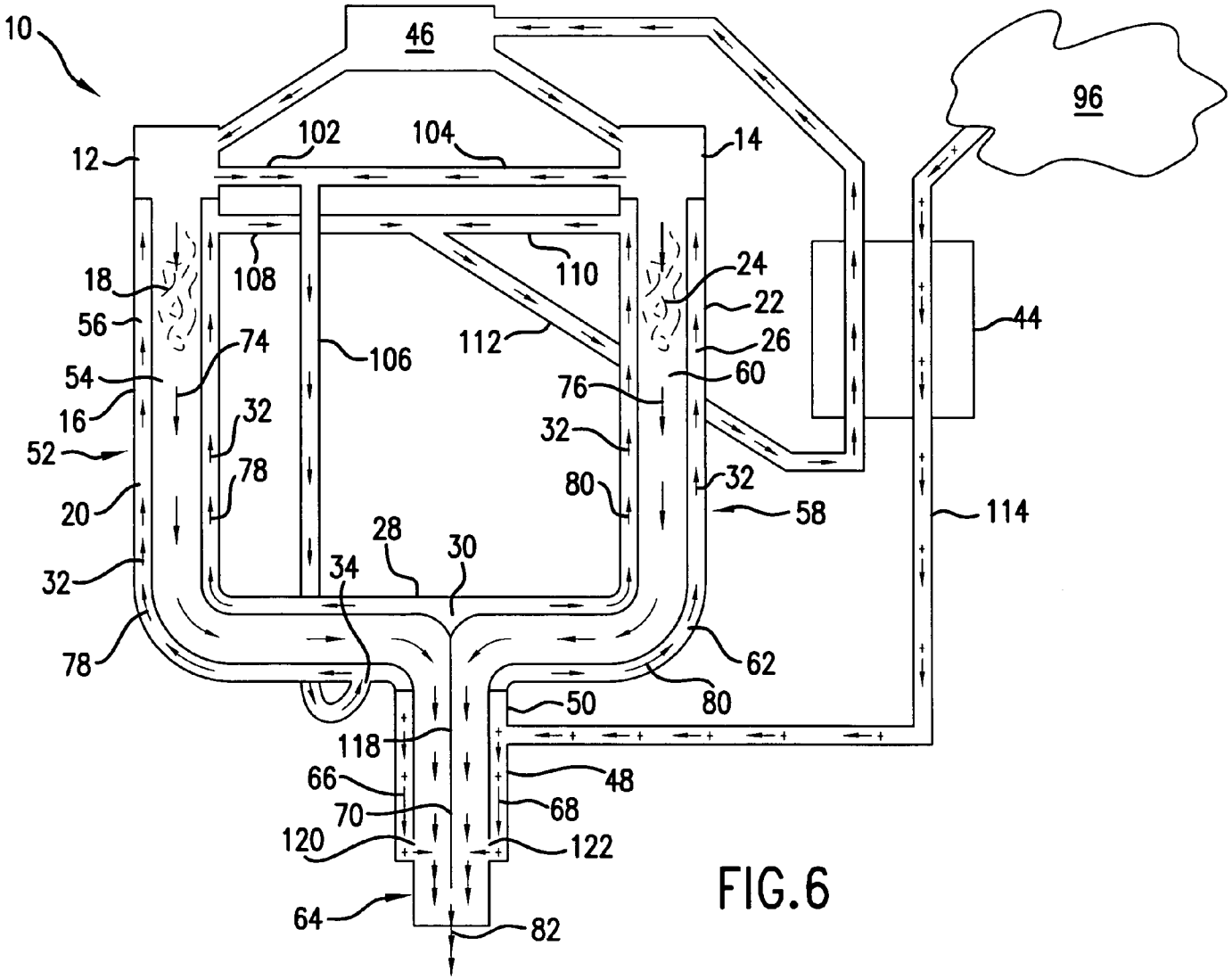
FIG. 6 is a schematic circuit view of the marine engine exhaust system of FIG. 5.

A further exemplary embodiment of the marine engine exhaust system 10 is shown in FIG. 5. This exemplary embodiment is similar to the one previously described with respect to FIG. 4 with the addition of certain elements such as an elbow 48 and riser 50. As with previous embodiments, the marine engine exhaust system 10 includes a pair of manifolds 12 and 14 with catalysts 36 and 42. The system 10 is a fresh water system in which antifreeze is used as the cooling fluid 32. FIG. 6 is a schematic circuit view of the marine engine exhaust system 10. Certain elements of system 10 are arranged in a manner similar to those previously discussed and as such a repeat of this information is not necessary. For example, the cooling fluid 32 flows from the crossover cooling fluid passageway 30 and into the first and second cooling fluid passageways 56 and 62.

The marine engine exhaust system 10 in FIG. 6 includes a crossover 30 through which the first gas 18 and second gas 24 flow without mixing with one another or with cooling water 66 and 68. Instead, the two separate streams of gas 18 and 24 flow through the riser 50 and into elbow 48. Cooling water in line 114 from the heat exchanger 44 enters the riser 50 through port 86. As such, cooling water from line 114 does not enter the crossover 28. Cooling water from line 114 flows into elbow 48 and is designated as cooling water 66 and cooling water 68. Cooling water 66 merges with the first gas 18 and cooling water 68 merges with the second gas 24 before the first gas 18 and second gas 24 merge with one another. These combined streams are shown as double arrows in FIG. 6. This arrangement functions to condense and cool the first and second gas 18 and 24 which reduces backpressure on the engine 46. A combined stream 82 of the first gas 18, second gas 24, cooling water 66 and cooling water 68 is subsequently formed and expelled from the system 10. Combined stream 82 is shown as a triple arrow in FIG. 6.

Figure 7:
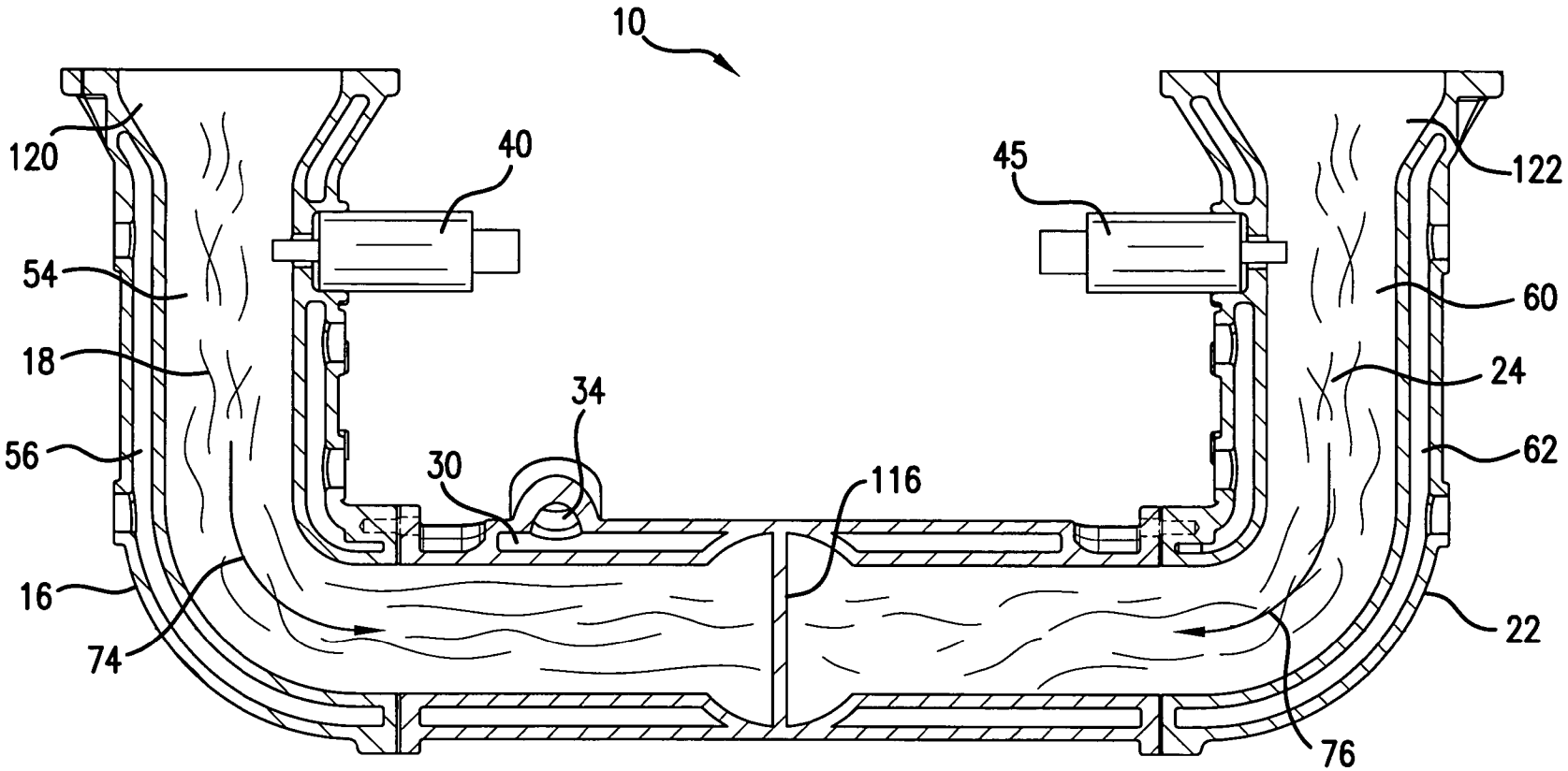
FIG. 7 is a cross-sectional view showing the corners and crossover of the marine engine exhaust system of FIG. 5.

A cross-sectional view of the first corner 16, second corner 22 and crossover 28 is shown in FIG. 7. As shown, the first corner cooling fluid passageway 20 completely surrounds the first gas 18, and the second corner cooling fluid passageway 26 surrounds the second gas 24. The passageways 20 and 26 are placed into fluid communication with the crossover cooling fluid passageway 30 in a manner similar to that previously discussed with respect to the exemplary embodiment in FIG. 1. However, it is to be understood that the passageways 20 and 26 can be placed into fluid communication with crossover cooling fluid passageway 30 in a variety of manners such as those described above with reference to the exemplary embodiment of FIG. 1. A wall 116 is present in order to prevent the first gas 18 and second gas 24 from mixing in the crossover 28. Port 34 can be generally located at either the top or bottom of the crossover 28 to allow cooling fluid 32 to enter and fill the crossover cooling fluid passageway 30 from the bottom to the top. Cooling water 66 and 68 does not mix with the first gas 18 and second gas 24 in the crossover 28. The first corner 16 and second corner 22 are separate components that are attached to the crossover 28. However, in other embodiments these components may be either one single piece or made of two separate pieces. Various attributes of the crossover 28, first corner 16 and second corner 22 can be provided in a manner similar to that discussed above with reference to previous exemplary embodiments and a repeat of this information is not necessary.

Cooling fluid 32 enters the crossover cooling fluid passageway 30 through port 34 and proceeds to fill the crossover cooling fluid passageway 30 from the bottom up due to gravity. The cooling fluid 32 then flows into the first and second cooling fluid passageways 56 and 62 in a manner similar to that previously discussed with respect to the exemplary embodiment in FIG. 1. The arrangement of the marine engine exhaust system 10 in FIG. 6 is made to reduce hot spots on the corners 16 and 22 and crossover 28 and a repeat of this information is not necessary. Although described as cooling the entire lengths of the first corner 16, second corner 22 and crossover 28 it is to be understood that the entire lengths of these elements need not be cooled by the cooling fluid 32 in accordance with other embodiments.

Figure 8:
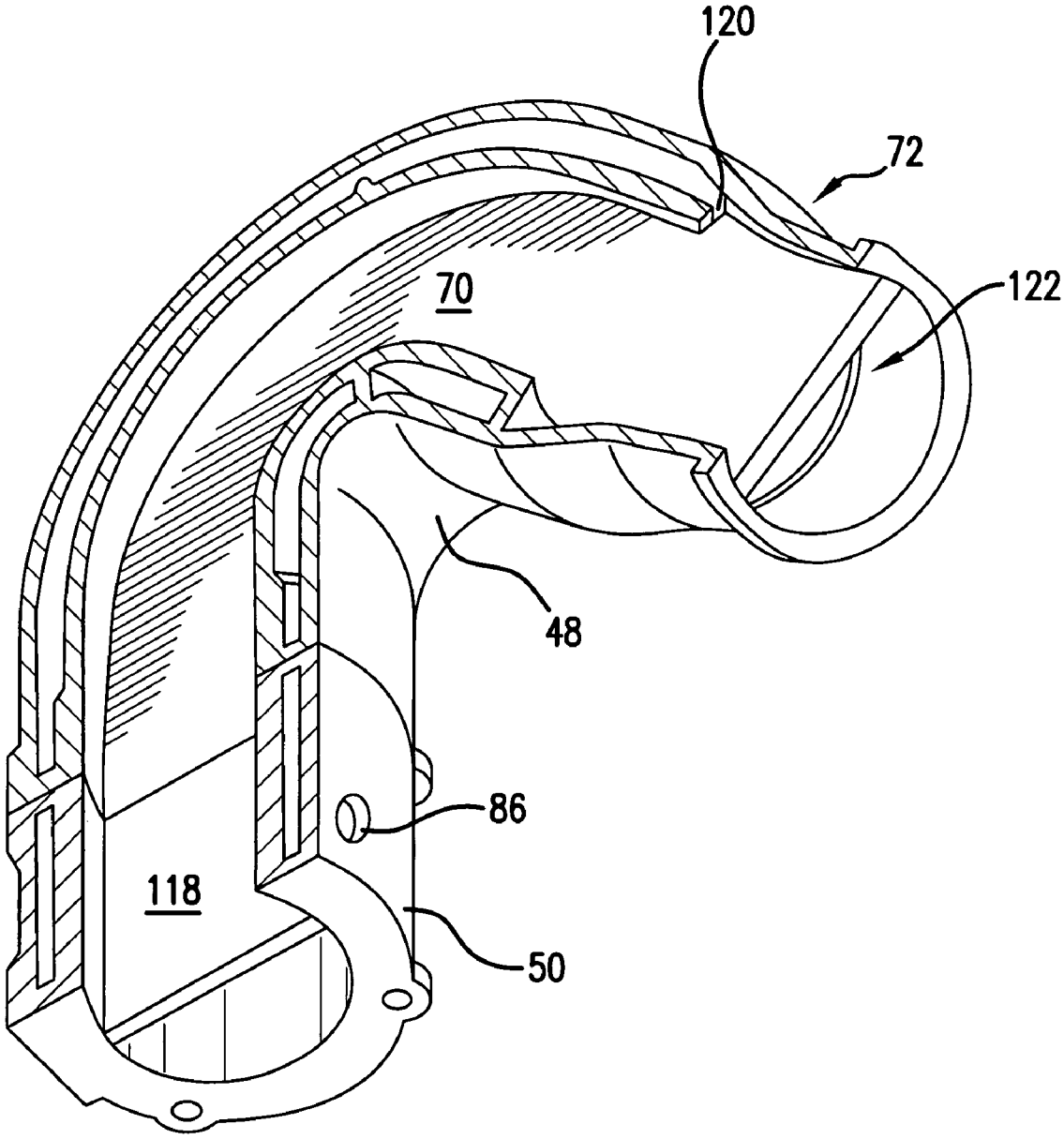
FIG. 8 is a cross-sectional view of the riser and elbow of the marine engine exhaust system of FIG. 5.

With reference now to FIGS. 5 and 8, the marine engine exhaust system 10 is shown as employing elbow 48 and riser 50. The first gas 18 and second gas 24 exit the crossover 28 and flow into one or more risers 50. The risers 50 function to allow the first and second gases 18 and 24 to be transported upwards in the vertical direction. Upwards elevation of the gases 18 and 24 may be necessary in order to discharge the gases 18 and 24 over a wall or other structure of the watercraft. A wall 118 is present in riser 50 in order to keep the first gas 18 separate from the second gas 24 as they flow therethrough. If additional risers 50 are stacked on top of one another to achieve a desired height the additional risers 50 can also include the wall 118 to keep the gases 18 and 24 separate through their transfer length.

An elbow 48 is connected to the riser 50 and discharges the exhaust gases 18 and 24 from a tip 72 into the body of water in which the watercraft is deployed or into a hose 94 (not shown). The riser 50 is connected to an inlet of the elbow 48. The elbow 48 includes a wall 70 throughout a portion of its length which acts to maintain the gases 18 and 24 separate throughout this portion of the elbow 48. An inlet 120 through which cooling water 66 is dispensed is in communication with the first gas passageway 54 of the first conduit 52. Inlet 122 through which cooling water 68 can be transferred is in communication with the second gas passageway 60 of the second conduit 58. Cooling water 66 is merged with the first gas 18 to form a combined stream, and cooling water 68 is mixed with the second gas 24 to likewise form a combined stream. At this point, the wall 70 acts to maintain the gases 18 and 24 separate from one another. As such, cooling water 66 and 68 is mixed with the gases 18 and 24 before the gases 18 and 24 are mixed with one another. The addition of cooling water 66 and 68 before the gases 18 and 24 are merged with one another acts to cool the individual gas streams 18 and 24 and reduce backpressure on the engine 46 as previously discussed. The inlets 120 and 122 may be located at the top of the conduits 52 and 58 so that the cooling water 66 and 68 may be dispensed through a larger amount of the first and second gases 18 and 24 to increase the amount of cooling.

The combined streams can be merged with one another to form a combined stream 82 of cooling water 66 and 68 and gases 18 and 24. Combined stream 82 exits the elbow 48 from the tip 72. The gases 18 and 24 can be maintained separate from the cooling water 66 and 68 until the tip 72 of the elbow 48 in order to maximize the distance between the introduction of the cooling water 66 and 68 into the conduits 52 and 58 and the manifolds 12 and 14. This configuration helps to keep the cooling water 66 and 68 remote from the catalysts 36 and 42 and associated oxygen sensors 38, 40, 41 and 45 and the engine 46 to prevent damage thereto. In this configuration, water will have to transfer through reversion a great distance thus reducing the odds of water damaging the aforementioned components.

Although described and shown as mixing at the tip 72, the combined stream of first gas 18 and cooling water 66 and the combined stream of second gas 24 and cooling water 68 need not mix at this location to form the combined stream 82 in other embodiments. For example, the elbow 48 may be configured so that the combined streams are sprayed from the tip 72 to an area outside of the watercraft or into a hose 94 (not shown). In this regard, the combined streams may either not merge with one another to form the combined stream 82 or may do so at a location away from the elbow 48.

The marine engine exhaust system 10 is designed so that the direction of flow of the first gas 18 and second gas 24 is not in the same direction as the cooling fluid 32 used to cool the first and second gases 18 and 24 in the conduits 52 and 58. For example, referring to FIG. 2, the first gas 18 is shown as having a direction of flow 74 that is not in the same direction as the direction of flow 78 of the cooling water 66 in the first conduit 52. In fact, the direction of flow 74 is opposite to that of the direction of flow 78. However, it is to be understood that other embodiments are possible in which the directions of flow 74 and 78 are not opposite to one another but are only different from one another. In a similar vein, the direction of flow 76 of the second gas 24 is not the same as, and is in fact opposite to, the direction of flow 80 of the cooling water 68 in the second conduit 58. Again, although shown as being completely opposite from one another the directions of flow 76 and 80 may only be different from one another in other embodiments. The directions of flow 74 and 78 may be the same as or different from one another in the third conduit 64. Similarly, the directions of flow 76 and 80 may be the same as or different from one another in the third conduit 64. Other disclosed embodiments are configured in a similar manner.

FIGS. 4 and 6 disclose fresh water systems in which the cooling fluid 32 is antifreeze instead of cooling water 66 and 68. However, the direction of flow 74 of the first gas 18 is different from the direction of flow 78 of the cooling fluid 32 in the first conduit 52. Likewise, the direction of flow 76 of the second gas 24 is different from the direction of flow 80 of the cooling fluid 32 in the second conduit 58. The fluid flow of the embodiments in FIGS. 4 and 6 is arranged in a manner as described above with respect to the version in FIG. 1 with the caveat that the cooling fluid 32 is antifreeze instead of water.

The aforementioned embodiments have been described as having a first corner 16 that is incorporated into a first conduit 52 and has having a second corner 22 that is incorporated into a second conduit 58. Further, the presence of a crossover 28 has been mentioned in all discussed embodiments. It is to be understood that other exemplary embodiments of the marine engine exhaust system 10 exist which do not include a first corner 16, second corner 22 or crossover 28. In these embodiments, the first conduit 52 and second conduit 58 can be configured into different types of components. Further, the third conduit 64 can be a different type of component and need not have a crossover 28 or elbow 48 incorporated therein.

The present application involves subject matter that relates to that disclosed in U.S. patent application Ser. No. 11/729,671 entitled, "Marine Engine Exhaust System" filed Mar. 29, 2007. The entire contents of U.S. patent application Ser. No. 11/729,671 are incorporated by reference herein in their entirety for all purposes.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A marine engine exhaust system, comprising:

a first manifold;

a second manifold;

a first corner in fluid communication with said first manifold such that a first gas exiting said first manifold is transferred into said first corner, wherein said first corner has a first corner cooling fluid passageway;

a second corner in fluid communication with said second manifold such that a second gas exiting said second manifold is transferred into said second corner, wherein said second corner has a second corner cooling fluid passageway; and a crossover in fluid communication with said first corner and said second corner such that the first gas exiting said first corner is transferred into said crossover and such that the second gas exiting said second corner is transferred into said crossover, wherein said crossover has a crossover cooling fluid passageway configured for receiving cooling fluid, and wherein cooling fluid is transferred from said crossover cooling fluid passageway to said first corner cooling fluid passageway and said second corner cooling fluid passageway.

2. The marine engine exhaust system as set forth in claim 1, wherein the cooling fluid is water.

3. The marine engine exhaust system as set forth in claim 1, wherein said first manifold has a first catalyst for treating the first gas, and wherein said second manifold has a second catalyst for treating the second gas.

4. The marine engine exhaust system as set forth in claim 3, wherein an oxygen sensor that senses the first gas is located downstream from said first catalyst in the direction of flow of the first gas through said first manifold and said first corner, wherein said first manifold has an oxygen sensor that senses the first gas and is located upstream from said first catalyst in the direction of flow of the first gas through said first manifold;

wherein an oxygen sensor that senses the second gas is located downstream from said second catalyst in the direction of flow of the second gas through said second manifold and said second corner, wherein said second manifold has an oxygen sensor that senses the second gas and is located upstream from said second catalyst in the direction of flow of the second gas through said second manifold.

5. The marine engine exhaust system as set forth in claim 1, wherein the first gas and the second gas are maintained separate from one another in said crossover, and further comprising an elbow in fluid communication with said crossover such that the first gas exiting said crossover is transferred into said elbow and such that the second gas exiting said crossover is transferred into said elbow, wherein said elbow is configured to allow the first gas and the second gas to merge with one another.

6. A marine engine exhaust system, comprising:

a first manifold;

a second manifold;

a first corner in fluid communication with said first manifold such that a first gas exiting said first manifold is transferred into said first corner, wherein said first corner has a first corner cooling fluid passageway;

a second corner in fluid communication with said second manifold such that a second gas exiting said second manifold is transferred into said second corner, wherein said second corner has a second corner cooling fluid passageway; and a crossover in fluid communication with said first corner and said second corner such that the first gas exiting said first corner is transferred into said crossover and such that the second gas exiting said second corner is transferred into said crossover, wherein said crossover has a crossover cooling fluid passageway configured for receiving cooling fluid, and wherein said crossover cooling fluid passageway is configured for allowing cooling fluid therein to be transferred into said first corner cooling fluid passageway and said second corner cooling fluid passageway;

wherein said crossover defines a port to allow the cooling fluid to flow therethrough and into said crossover cooling fluid passageway.

7. A marine engine exhaust system, comprising:

a first manifold;

a second manifold;

a first corner in fluid communication with said first manifold such that a first gas exiting said first manifold is transferred into said first corner, wherein said first corner has a first corner cooling fluid passageway;

a second corner in fluid communication with said second manifold such that a second gas exiting said second manifold is transferred into said second corner, wherein said second corner has a second corner cooling fluid passageway; and a crossover in fluid communication with said first corner and said second corner such that the first gas exiting said first corner is transferred into said crossover and such that the second gas exiting said second corner is transferred into said crossover, wherein said crossover has a crossover cooling fluid passageway configured for receiving cooling fluid, and wherein said crossover cooling fluid passageway is configured for allowing cooling fluid therein to be transferred into said first corner cooling fluid passageway and said second corner cooling fluid passageway;

wherein said crossover cooling fluid passageway is oriented with respect to said first corner cooling fluid passageway and said second corner cooling fluid passageway such that cooling fluid transferred into said crossover cooling fluid passageway fills said crossover cooling fluid passageway before filling at least substantially all of said first corner cooling fluid passageway and said second corner cooling fluid passageway.

8. A marine engine exhaust system, comprising:

a first manifold;

a second manifold;

a first corner in fluid communication with said first manifold such that a first gas exiting said first manifold is transferred into said first corner, wherein said first corner has a first corner cooling fluid passageway;

a second corner in fluid communication with said second manifold such that a second gas exiting said second manifold is transferred into said second corner, wherein said second corner has a second corner cooling fluid passageway; and a crossover in fluid communication with said first corner and said second corner such that the first gas exiting said first corner is transferred into said crossover and such that the second gas exiting said second corner is transferred into said crossover, wherein said crossover has a crossover cooling fluid passageway configured for receiving cooling fluid, and wherein said crossover cooling fluid passageway is configured for allowing cooling fluid therein to be transferred into said first corner cooling fluid passageway and said second corner cooling fluid passageway;

wherein said crossover is configured such that the first gas and the second gas merge therein, and wherein cooling water is merged with the first gas and with the second gas before the first gas and the second gas merge with one another in said crossover.

9. A marine engine exhaust system, comprising:

a first manifold;

a second manifold;

a first corner in fluid communication with said first manifold such that a first gas exiting said first manifold is transferred into said first corner, wherein said first corner has a first corner cooling fluid passageway;

a second corner in fluid communication with said second manifold such that a second gas exiting said second manifold is transferred into said second corner, wherein said second corner has a second corner cooling fluid passageway;

a crossover in fluid communication with said first corner and said second corner such that the first gas exiting said first corner is transferred into said crossover and such that the second gas exiting said second corner is transferred into said crossover, wherein said crossover has a crossover cooling fluid passageway configured for receiving cooling fluid, and wherein said crossover cooling fluid passageway is configured for allowing cooling fluid therein to be transferred into said first corner cooling fluid passageway and said second corner cooling fluid passageway; and further comprising a heat exchanger, wherein the cooling fluid is antifreeze and said first corner cooling fluid passageway and said second corner cooling fluid passageway are configured to allow the antifreeze to be transferred therefrom and into said heat exchanger in order to be cooled, and wherein said heat exchanger is configured to allow the antifreeze to be transferred therefrom and to an engine in order to cool the engine.

10. A marine engine exhaust system, comprising:

a first manifold;

a second manifold;

a first corner in fluid communication with said first manifold such that a first gas exiting said first manifold is transferred into said first corner, wherein said first corner has a first corner cooling fluid passageway;

a second corner in fluid communication with said second manifold such that a second gas exiting said second manifold is transferred into said second corner, wherein said second corner has a second corner cooling fluid passageway;

a crossover in fluid communication with said first corner and said second corner such that the first gas exiting said first corner is transferred into said crossover and such that the second gas exiting said second corner is transferred into said crossover, wherein said crossover has a crossover cooling fluid passageway configured for receiving cooling fluid, and wherein said crossover cooling fluid passageway is configured for allowing cooling fluid therein to be transferred into said first corner cooling fluid passageway and said second corner cooling fluid passageway;

wherein the first gas and the second gas are maintained separate from one another in said crossover, and an elbow in fluid communication with said crossover such that the first gas exiting said crossover is transferred into said elbow and such that the second gas exiting said crossover is transferred into said elbow, wherein said elbow is configured to allow the first gas and the second gas to merge with one another;

a heat exchanger, wherein the cooling fluid is antifreeze and said first corner cooling fluid passageway and said second corner cooling fluid passageway are configured to allow the antifreeze to be transferred therefrom and into said heat exchanger in order to be cooled, and wherein said heat exchanger is configured to allow cooling water to be transferred therethrough to be heated by the antifreeze and to be transferred to said elbow, wherein the cooling water is merged with the first gas and the second gas before the first gas and the second gas merge with one another in said elbow.

11. The marine engine exhaust system as set forth in claim 10, further comprising at least one riser located between said crossover and said elbow so as to place said crossover into fluid communication with said elbow, wherein said crossover is configured such that the first gas and the second gas exiting said crossover are transferred into said riser and are kept separate from one another and move vertically upwards and are transferred from said riser into said elbow, and wherein said heat exchanger is configured to transfer the cooling water from said heat exchanger into said riser for subsequent transfer into said elbow.

12. A marine engine exhaust system, comprising:

a first manifold;

a second manifold;

a first conduit in fluid communication with said first manifold such that a first gas exiting said first manifold is transferred into a first gas passageway of said first conduit, wherein said first conduit has a first cooling fluid passageway; and a second conduit in fluid communication with said second manifold such that a second gas exiting said second manifold is transferred into a second gas passageway of said second conduit, wherein said second conduit has a second cooling fluid passageway;

wherein cooling fluid is transferred through said first cooling fluid passageway so as to have a direction of flow through said first conduit opposite to the direction of flow of the first gas through said first gas passageway of said first conduit.

13. The marine engine exhaust system as set forth in claim 12, wherein cooling fluid is transferred through said second cooling fluid passageway so as to have a direction of flow through said second conduit opposite to the direction of flow of the second gas through said second gas passageway of said second conduit.

14. The marine engine exhaust system as set forth in claim 12, further comprising a third conduit in fluid communication with said first conduit and said second conduit such that the first gas exiting said first conduit and the second gas exiting said second conduit merge in said third conduit;

wherein cooling water is merged with the first gas in said first conduit and with the second gas in said second conduit before the first gas and the second gas merge in said third conduit.

15. The marine engine exhaust system as set forth in claim 14, wherein said third conduit defines a port to allow the cooling fluid to flow therethrough and into said first cooling fluid passageway and said second cooling fluid passageway.

16. The marine engine exhaust system as set forth in claim 12, wherein said first manifold has a first catalyst for treating the first gas, and wherein said second manifold has a second catalyst for treating the second gas;

wherein an oxygen sensor that senses the first gas is located downstream from said first catalyst in the direction of flow of the first gas through said first manifold and said first conduit, wherein said first manifold has an oxygen sensor that senses the first gas and is located upstream from said first catalyst in the direction of flow of the first gas through said first manifold;

wherein an oxygen sensor that senses the second gas is located downstream from said second catalyst in the direction of flow of the second gas through said second manifold and said second conduit, wherein said second manifold has an oxygen sensor that senses the second gas and is located upstream from said second catalyst in the direction of flow of the second gas through said second manifold.

17. The marine engine exhaust system as set forth in claim 12, further comprising a heat exchanger, wherein the cooling fluid is antifreeze and said first cooling fluid passageway and said second cooling fluid passageway are configured to allow the antifreeze to be transferred therefrom and into said heat exchanger in order to be cooled, and wherein said heat exchanger is configured to allow the antifreeze to be transferred therefrom and to an engine in order to cool the engine.

18. A marine engine exhaust system, comprising:

a first corner configured for the transfer of a first gas therethrough, wherein said first corner has a first corner cooling fluid passageway;

a second corner configured for the transfer of a second gas therethrough, wherein said second corner has a second corner cooling fluid passageway; and a crossover in fluid communication with said first corner and said second corner such that the first gas exiting said first corner is transferred into said crossover and such that the second gas exiting said second corner is transferred into said crossover;

wherein cooling fluid is located in said first corner cooling fluid passageway and flows therethrough, wherein the direction of flow of the first gas through said first corner is different than the direction of flow of the cooling fluid through said first corner.

19. The marine engine exhaust system as set forth in claim 18, wherein cooling fluid is located in said second corner cooling fluid passageway and flows therethrough, wherein the direction of flow of the first gas through said first corner is different than the direction of flow of the cooling fluid through said first corner;

wherein the direction of flow of the cooling fluid through said first corner is opposite to the direction of flow of the first gas through said first corner, and wherein the direction of flow of the cooling fluid through said second corner is opposite to the direction of flow of the second gas through said second corner.

20. The marine engine exhaust system as set forth in claim 19, further comprising:

a first manifold in fluid communication with said first corner such that the first gas is transferred from said first manifold to said first corner, wherein said first manifold has a first catalyst for treating the first gas;

a second manifold in fluid communication with said second corner such that the second gas is transferred from said second manifold to said second corner, wherein said second manifold has a second catalyst for treating the second gas;

wherein said crossover has a crossover cooling fluid passageway configured for receiving cooling fluid through a port, and wherein said crossover cooling fluid passageway is configured for allowing cooling fluid therein to be transferred into said first corner cooling fluid passageway and said second corner cooling fluid passageway.

* * * * *